United States Patent [19]

Clark

[11] 4,095,382

[45] Jun. 20, 1978

[54] AIRCRAFT HANGAR CONSTRUCTION

[76] Inventor: Otis A. Clark, Rte. 2, Box 193-E, Tecumseh, Okla. 74873

[21] Appl. No.: 789,512

[22] Filed: Apr. 21, 1977

[51] Int. Cl.[2] ..... E04H 1/00

[52] U.S. Cl. ..... 52/234; 52/648

[58] Field of Search ..... 52/234, 236.1, 79.4, 52/574, 648, 65, 71, 94; 49/425, 409

[56] References Cited

U.S. PATENT DOCUMENTS 3,346,997 10/1967 Parrish ..... 52/236.1 X

*Primary Examiner*—Stephen J. Novosad
*Assistant Examiner*—Carl D. Friedman
*Attorney, Agent, or Firm*—William R. Laney

[57] ABSTRACT

An aircraft hangar construction which includes a plurality of horizontally extending transverse roof frame members; a vertical supporting member supporting the central portion of each of the transverse roof frame members and contacting the lower side thereof; horizontally extending roof frame members secured to the opposite ends of each of the transverse roof frame members and extending in substantially the same plane as the transverse roof frame members; and at least two vertical supporting members supporting each of the last-mentioned roof frame members at locations spaced inwardly therealong from the opposite ends thereof and collectively defining the spaced planes of opposed parallel sides of the hangar. Partition subassemblies are located within the hangar between the planes of the opposed parallel sides of the hangar and each includes a plurality of vertical walls which define two complementary, internesting T-shaped hangar spaces which open at opposite sides of the hangar and facilitate the entry of aircraft into each of the adjacent complementary T-shaped hangar spaces from opposite sides of the hangar. The described vertical walls of each pair of complementary T-shaped hangar spaces include three walls which are disposed intermediate the planes of the opposed side walls of the hangar, and which each extend between spaced pairs of said first-mentioned vertical supporting members.

20 Claims, 7 Drawing Figures

AIRCRAFT HANGAR CONSTRUCTION

BACKGROUND OF THE INVENTION

1. Brief Description of the Prior Art

For the purpose of providing the most efficient storage of aircraft having relatively large wing span dimensions in a minimum of hanger space, it has heretofore been proposed to construct hangar buildings for receiving and housing these aircraft so that the hangars enclose and define a plurality of interfitted T-shaped hangar spaces in which the hangar spaces are complementary in configuration, and open at opposite sides of the hangar so that the aircraft stored therein are staggered, with the tail sections of the adjacent housed aircraft extending toward opposite sides of the hangar. These so-called T-hangars enable the maximum number of similar aircraft with large wing span dimensions to be parked, housed and maintained in a minimum enclosed area.

In constructing T-hangars of the type described, conventional practice to the present time has been to provide a roof which is supported upon a plurality of truss-type roof frames overlain by secondary framing members. The truss-type primary roof framing members extend transversely across the T-hangars and are supported in cantilevered fashion. Thus, a central, vertically extending supporting beam is extended upwardly to the central lower side of the truss frame member and provides support at this point. One end of the truss member is then secured to another vertically extending supporting member which is located at one side of the hangar. A plurality of the described transversely extending truss frame members are, of course, spaced along the length of the hangar, with the distance which separates adjacent truss members generally being that which is needed to accommodate the tail section of an aircraft housed in the hangar.

In order to permit a much larger space to exist longitudinally of the hangar at the opposite side of the hangar from that which will house the tail section, it is necessary that the second end of each of the truss members be cantilevered; that is, unsupported. In this way, no obstructing, vertically extending structural supporting members are located at the second end of each truss member, and this enables an opening to be formed at one side of the hangar to pass the extended wings of the aircraft when it is moved into the hangar.

The cantilevered means of support of the roof framing members which has previously been used and employed in the manner described has required the usage of heavy truss members of a thickened central section and of generally triangular overall configuration, and such structural members are expensive to fabricate and to utilize in construction. Their use has been required, however, in order to provide structural strength adequate to support the roof upon the cantilevered framing members constituted by the trusses, and to permit the necessary openings to be provided at the opposite sides of the hangar for passage of the wings of aircraft moved into the storage space provided.

2. General Description of the Present Invention

The present invention provides an improved construction of a T-hangar for housing aircraft, which construction permits conventional stock beams of I- or H-shaped cross-sectional configuration to be employed in the roof construction as primary framing members. The need for using heavy, specially shaped truss members in an expensive construction in order to provide cantilevered supports for the roof is eliminated.

Broadly described, the aircraft hangar construction of the invention includes a plurality of horizontally extending, transverse primary roof frame members which are each supported at a medial portion thereof by a vertically extending supporting member which contacts the lower side of the respective transverse primary frame member. Horizontally extending longitudinal roof frame members are secured to each of the opposite ends of each transverse roof primary frame member and extend normal thereto with these longitudinal frame members at opposite ends of the transverse roof frame members being located in substantially the same horizontal plane as the transverse roof frame members. At least two vertical supporting members are employed for supporting each of the longitudinal roof frame members, and these are positioned at locations which are spaced inwardly therealong from the opposite ends of each longitudinal roof frame member. The longitudinal roof frame members, and their associated vertical supporting members collectively define the opposed spaced planes of opposed parallel longitudinal sides of the T-hangar.

Partition subassemblies are located within the hangar between the planes of the opposed parallel sides of the hangar as defined by the longitudinal roof frame members and their associated vertical supporting members. Each of the partition subassemblies includes a plurality of vertical compartment walls which preferably define at least two complementary T-shaped hangar spaces which are contiguous to each other and open respectively at opposite sides of the hangar, thereby facilitating the entry of aircraft into each of the adjacent complementary T-shaped hangar compartments from opposite sides of the hangar. The described vertical walls of each pair of complementary contiguous T-shaped hangar compartments include three defining walls which are disposed intermediate the planes of the opposed longitudinal side walls of the hangar, and which are each connected to at least one of the vertical supporting members used for supporting a transverse primary roof frame member.

The described T-hangar construction provides support for the transverse primary roof frame members at the opposite ends thereof by the connection there established between these primary frame members and the longitudinal frame members to which they are connected. Cantilevering of the transverse primary roof frame members is thus eliminated, and such frame members can be constructed, and are preferably constructed, of readily available I-beams or H-beams.

In a preferred embodiment of the invention, the T-hangar construction of the invention further includes an improved roof eave construction in which a simpler and less expensive structural arrangement is provided for securing the longitudinal side wall panels to the transverse primary roof frame members, and for mounting sliding or rolling hangar doors adjacent such side wall panels.

An important object of the present invention is to provide an improved T-hangar construction which can be constructed at lower cost, and yet provides greater structural strength and stability than such hangars as previously constructed.

A further object of the invention is to provide a T-hangar construction for aircraft in which the roof of the hangar structure can be only slightly pitched or inclined, and can be more readily and easily assembled than in prior T-hangar constructions.

A further object of the invention is to eliminate the necessity for providing a cantilevered roof section in a T-hangar constructed to facilitate the entry of large-winged aircraft into the opposite sides thereof for housing in contiguous, oppositely facing T-shaped compartments.

Additional objects and advantages of the invention will become apparent as the following detailed description of preferred embodiments of the invention is read in conjunction with the accompanying drawings which illustrate such preferred embodiments.

GENERAL DESCRIPTION OF THE DRAWINGS

Figure 5:
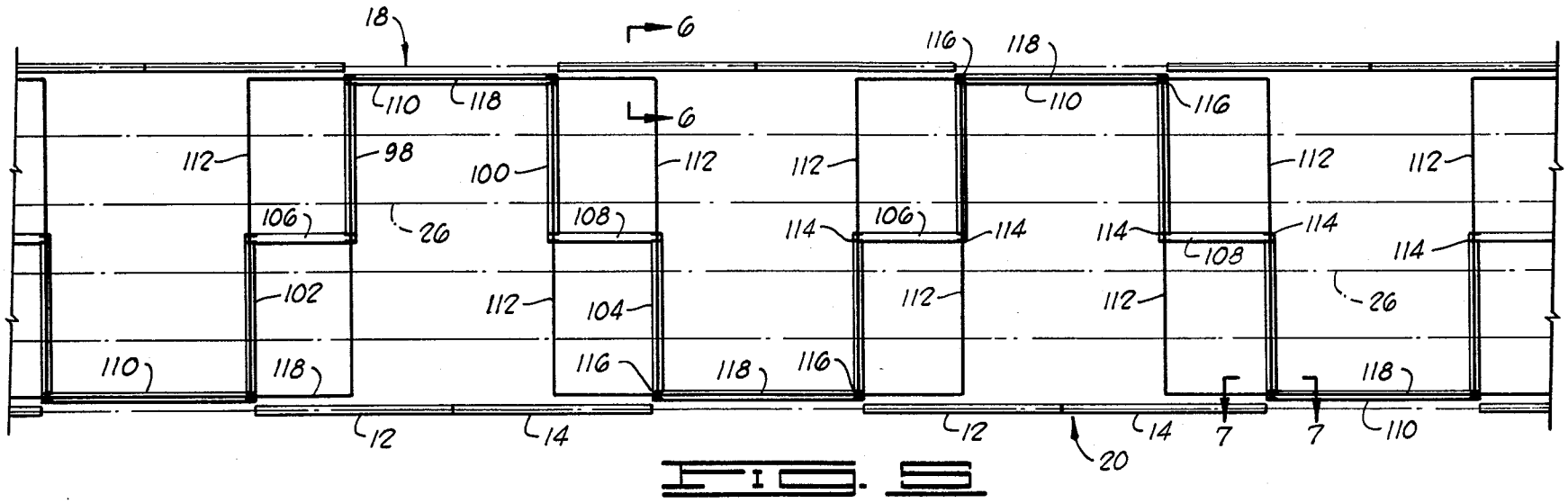
FIG. 5 is a plan view similar to FIGS. 2 and 4, but illustrating yet another embodiment of the invention.
Figure 6:
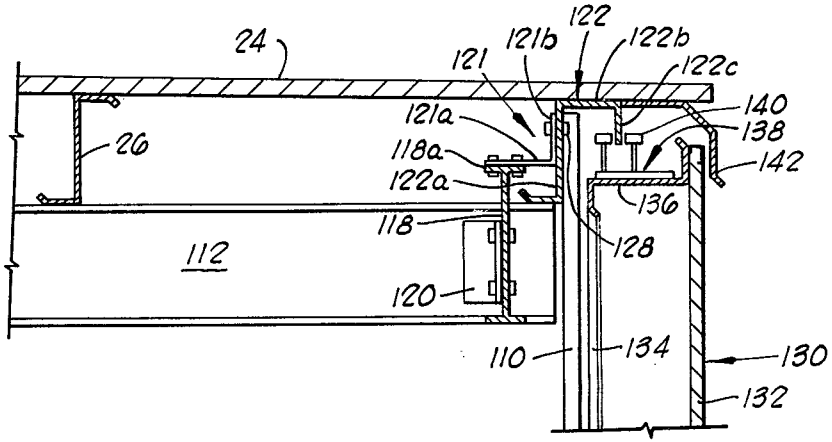

FIG. 6 is a partial sectional view taken along line 6—6 of FIG. 5 at the location of the eaves at one side of the roof of a hangar constructed in accordance with the present invention, and illustrating the manner in which the longitudinal side walls and door structures of the hangar are structurally interconnected and associated with the primary and secondary roof frame members and the roof panelling which is placed thereover.

Figure 7:
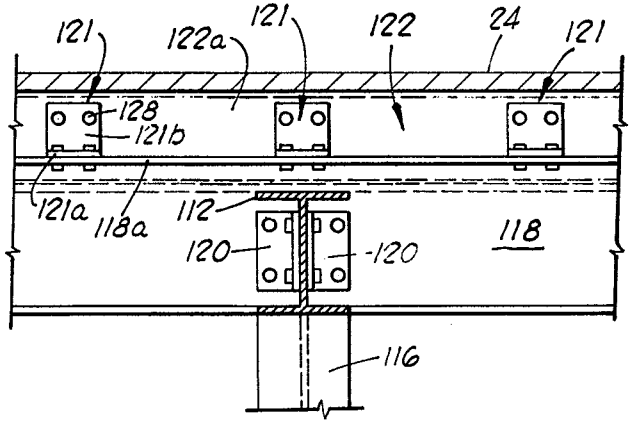

FIG. 7 is a sectional view taken along line 7—7 of FIG. 5.

DETAILED DESCRIPTION OF PREFERRED EMBODIMENTS OF THE INVENTION

Figure 1:
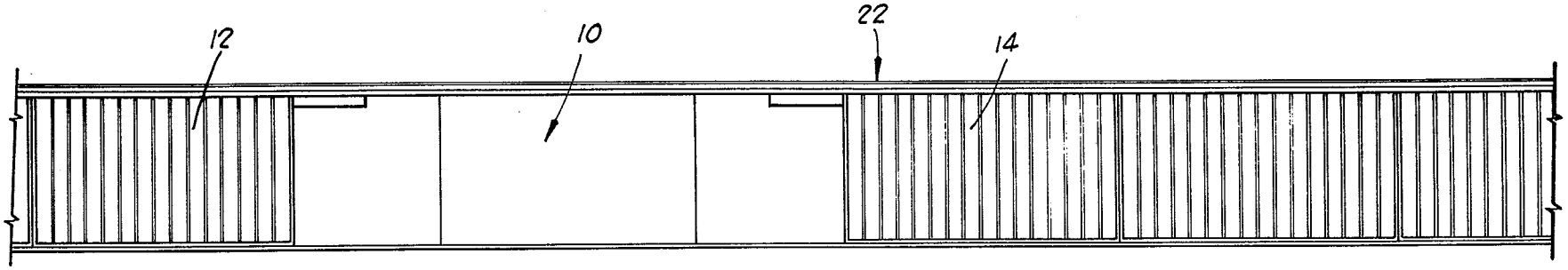
FIG. 1 is a side elevation view of a T-hangar constructed in accordance with the present invention illustrating a portion of one of the longitudinal faces or sides of the hangar structure.

In the side of the T-hangar illustrated in FIG. 1, one of the bays or compartments of the hangar is shown opened so as to provide a door opening designated generally by reference numeral 10. The hangar is opened at this point by sliding the doors 12 and 14 to a retracted position. The doors 12 and 14 slide back along side panels 15 which, collectively with the hangar doors, form the opposed longitudinal sides of the hangar. The hangar is built upon a supporting structure, such as a concrete pad 16 (see FIG. 3). The hangar includes opposed longitudinal side walls, designated generally by reference numerals 18 and 20 in FIG. 2, and a roof structure designated generally by reference numeral 22 in FIG. 1.

Figure 2:
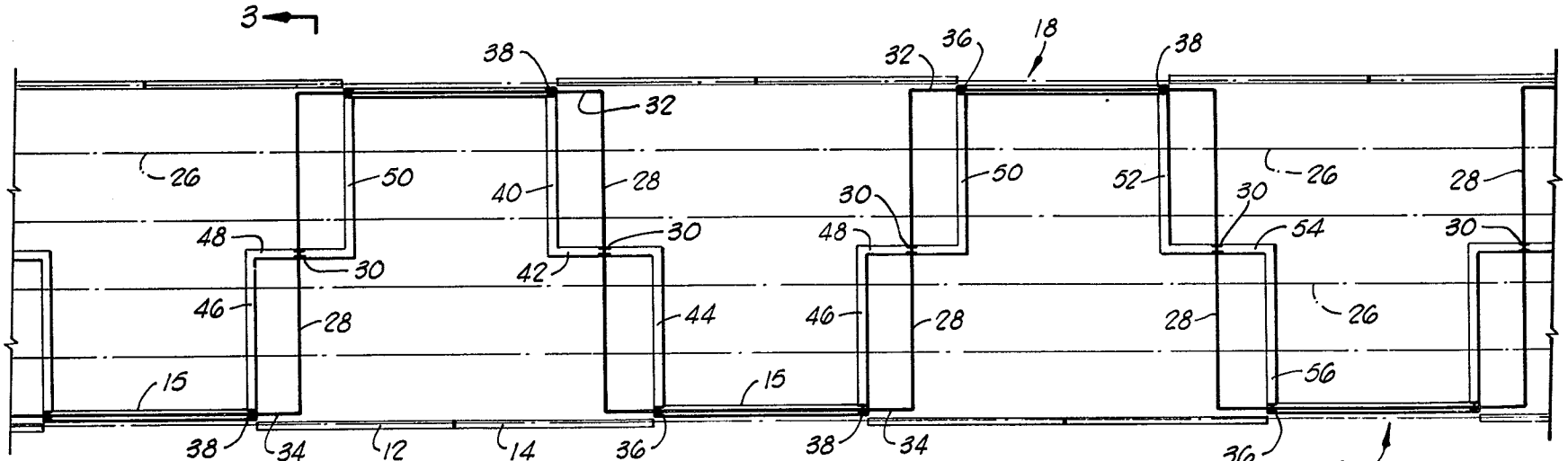
FIG. 2 is a schematic plan view of that portion of the T-hangar which is illustrated in FIG. 1 with the roof panels removed to show the secondary roof frame members, the primary roof frame members and the location of internal partition walls within the hangar structure.
Figure 3:
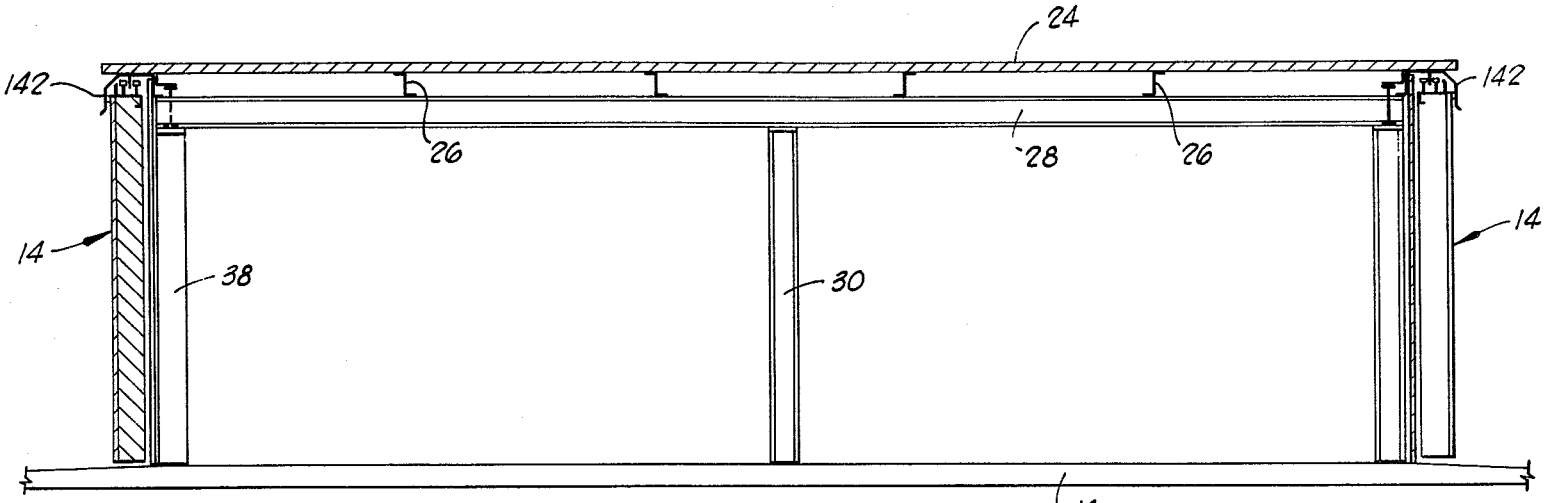
FIG. 3 is a sectional view taken along line 3—3 of FIG. 2, but illustrating the roof panels and door structures in place as used in the hangar.

The roof structure 22 includes suitable roof panelling 24 of conventional construction. The panelling 24 is supported upon a plurality of substantially parallel, longitudinally extending secondary roof frame members 26 which are also of conventional construction. The secondary roof frame members 26 rest upon, and are secured to, the upper sides of a plurality of horizontally extending, transverse primary roof frame members 28 which extend across the width of the hangar and are substantially parallel, as schematically illustrated in FIG. 2. The primary roof frame members 28 are preferably stock structural steel beams of I- or H-cross-sectional configuration. At a central or medial portion of each of the transverse primary roof frame members 28, each of these structural frame members is supported by a vertically extending supporting member 30. The vertical supporting members 30 can also be of conventional structural steel I- or H-beam construction and, as illustrated in FIG. 3, the lower end of each of the vertical supporting members is rested upon the pad 16, and the upper end thereof is bolted or otherwise suitably secured to the underside of the respective transverse primary roof frame member 28.

The corresponding aligned ends of each pair of adjacent transverse primary roof frame members 28 is secured to a longitudinally extending primary roof frame member 32 located at one of the longitudinal sides of the hangar, and disposed in substantially the same plane as the transverse primary roof frame members 28. In that portion of the T-hangar which is illustrated in FIGS. 1 and 2, and which illustrates four contiguous T-shaped aircraft housing compartments, it will be noted that two of the longitudinally extending primary roof frame members 32 are illustrated, and are shown as spaced longitudinally from each other, with opposite ends of each of the two longitudinally extending primary roof frame members joined to aligned ends of a pair of transverse primary roof frame members 28.

At the opposite longitudinal side of the hangar, additional spaced longitudinally extending primary roof frame members are provided and are each designated by reference numeral 34. It will be perceived that the opposite ends of each of the longitudinally extending primary roof frame members 34 is connected to the opposed or aligned ends of two adjacent transverse primary roof frame members 28, and it will further be noted that the longitudinal roof frame members are alternated, or transversely staggered, in relation to the longitudinally extending transverse roof frame members 32 on the opposite side of the hangar.

Each of the longitudinally extending primary roof frame members 32 and 34 is supported in its horizontally extending position at the ends of the transverse frame members 28 by means of a pair of vertically extending supporting members 36 and 38. The supporting members 36 and 38 are spaced inwardly from opposite ends of the respective longitudinal frame member 32 or 34 which they support, and are also spaced from the ends of the transverse frame members 28. The vertically extending supporting members 36 and 38 are of conventional construction, such as I-beams or H-beams, and the spacing between the paired vertical supporting members 36 and 38 which support each of the longitudinally extending primary roof frame members 32 and 34 is selected to afford a spacing which is slightly greater in dimension than is needed to accommodate the width of the tail section of an aircraft to be housed in the hangar. It will further be noted, in referring to FIG. 2, that the distance which separates each vertical supporting member 38 used for providing partial support to one of the longitudinal primary roof frame members 32 or 34 from the next adjacent vertical supporting member 36 which is employed to support a different longitudinal primary roof frame member (spaced from that supported by such supporting member 38 longitudinally along the side wall of the hangar) is sufficiently great to accommodate the entry into the hangar at one side thereof of the wing section of the aircraft. Stated differently, the spacings which are provided between the several vertical supporting members 36 and 38 as they are located along the opposite longitudinal sides of the hangar are such that internal partitioning can be provided so that the tail section of an aircraft can be housed along one side wall of the hangar, and the entire wing span of the aircraft can be housed along the other side of the hangar, with the facing direction of adjacent or contiguous aircraft housed in the hangar being reversed or opposite.

A plurality of partition subassemblies are located within the hangar between the opposite longitudinal side walls 18 and 20 thereof. It is convenient to speak of such partition subassemblies as including a plurality of vertical walls which define at least two complementary T-shaped hangar spaces or compartments within the hangar, since, in its most basic and simple form, the present invention contemplates the provision of two of such contiguous T-shaped hangar compartments. Thus, a partition subassembly may typically include the partition walls 40, 42, 44, 46, 48, 50, 52, 54 and 56 as shown in FIG. 2. The partition walls 40–56 extend vertically within the hangar and, it will be noted, include the longitudinally extending partition walls 42, 48 and 54 which are secured to and supported by spaced vertical supporting members 30 employed for supporting the midportion of three of the transverse main roof frame members 28. The described partition subassembly which includes the array of internal vertically extending partition walls 40–56 includes wall pairs 44 and 46 which extend transversely inwardly from a pair of vertical supporting members 36 and 38 disposed at one side 20 of the hangar, and wall pairs 50 and 52 which extend transversely inwardly in the hangar from a pair of vertically extending supporting members 36 and 38 located at the side 18 of the hangar. It will be noted that the wall pairs 44, 46 and 50, 52, respectively, define spaces which are sufficiently large in longitudinal dimension to accommodate the tail section of aircraft parked or housed within the hangar with adjacent aircraft faced toward opposite sides of the hangar.

In similar fashion, the wall pairs 40 and 50 project transversely inwardly from vertical supporting members 36 and 38 disposed at the side wall 18 of the hangar, and define a space having a sufficiently large longitudinal dimension to accommodate the wing span of a large aircraft positioned in the hangar. The same relationship is true of the wall pairs 46 and 56 which project transversely into the hangar from a pair of vertical supporting members 36 and 38 located at the side 20 of the hangar.

The pattern of construction which includes contiguous T-shaped compartments as defined by the vertically extending partition walls 40–56 can, of course, be repeated over the length of the hangar to provide as many of the T-shaped hangar compartments as may be desired.

It will be noted that the described construction affords support for each of the transverse primary roof frame members 28 at the central portion thereof by means of the vertically extending supporting member 30, as well as at the opposite ends thereof by reason of the connection of each transverse main roof frame member 28 to a pair of longitudinally extending main roof frame members 32 and 34. Cantilevering of the transverse main roof frame members 28 is thus eliminated, since each of the longitudinally extending main roof frame members 32 and 34 is itself supported by a pair of vertically extending supporting members 36 and 38. The arrangement still preserves, however, the enlarged openings at alternate sides of the hangar to allow the aircraft to be housed therein in staggered relation, with the tail sections disposed adjacent one side of the hangar and the wing section accommodated in the enlarged portion of each T-shaped compartment located at the other side of the hangar. The construction enables lighter and less expensive conventional structural steel I- and H-beams to be employed as primary roof frame members throughout the hangar structure, and eliminates the need to employ heavy specially shaped trusses as transverse primary roof frame members.

Figure 4:
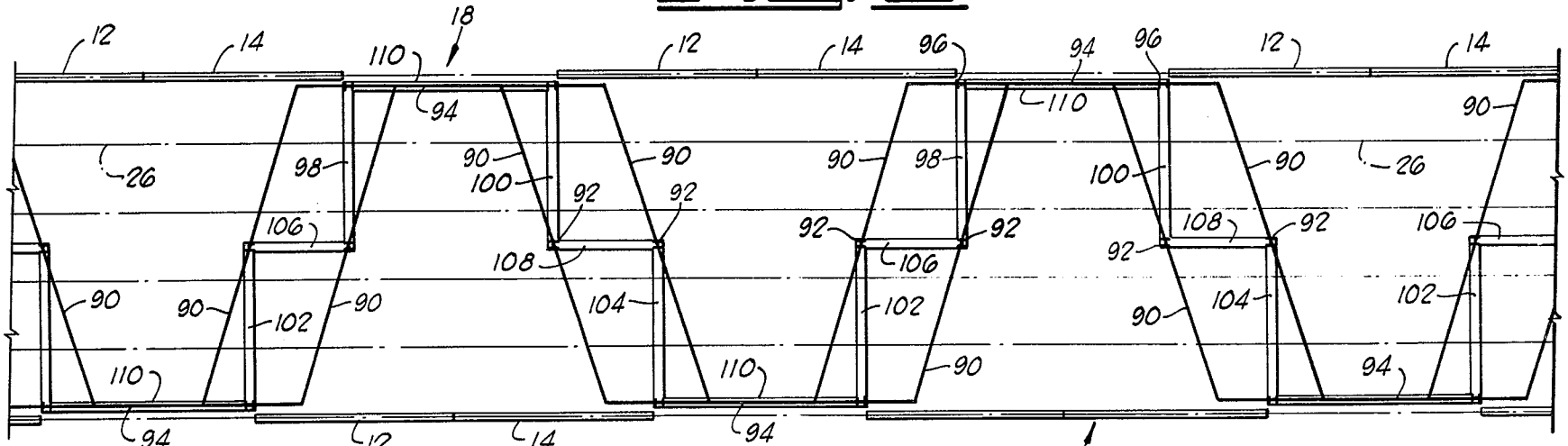
FIG. 4 is a plan view of a portion of a hangar constructed in accordance with the general principles of the invention, but illustrating a modified construction which can be employed.

In FIG. 4 of the drawings, a modified embodiment of the present invention is illustrated. In the depicted embodiment of the invention, the transverse primary roof frame members used in the T-hangar are designated by reference numeral 90 and are projected diagonally across the width of the hangar as here illustrated. The transverse primary roof frame members 90 are supported at a medial or centrally located portion by vertically extending supporting members 92. The ends of each adjacent pair of the transverse primary roof frame members 90 which are located in aligned relation at the side wall 18 of the hangar are connected to a common longitudinally extending primary roof frame member 94 which is supported by vertically extending supporting members 96 spaced inwardly from its opposite ends. It will thus be noted that the adjacent pairs of transverse frame members 90 and the opposed, substantially parallel longitudinal frame members 94 to which they are connected collectively form parallelogram figures projecting diagonally across the hangar at an acute angle to the longitudinal axis of the hangar.

As in the case of the embodiment of the invention depicted in FIGS. 1–3 and hereinbefore described, the spacing between the vertically extending supporting members 96 which support the several longitudinally extending primary frame members 94 at opposite sides of the hangar is such that they may be used as support points for vertically extending partition walls which, at one side of the hangar, are longitudinally spaced from each other to accommodate the aircraft tail section, and at the other side of the hangar are sufficiently spaced to accommodate the extended wings of the housed aircraft. Thus, for example, the vertically extending partition walls 98 and 100 which extend transversely inwardly from the vertically extending support members 96 at the side 18 of the hangar are spaced to accommodate the tail section of an aircraft, and the vertically extending partition walls 102 and 104 are spaced to accommodate the wings of the same aircraft. The T-shaped compartment for this aircraft is completed by the inclusion of the walls 106 and 108 which extend, respectively, between partition walls 102 and 98, and partition walls 100 and 104, and are secured to and supported by the vertically extending supporting members 92. The side wall sections 110 of the hangar which extend between adjacent supporting members 96 are spaced from each other to accommodate the sliding door pairs 12 and 14 of the hangar as hereinbefore described.

Yet another embodiment of the invention is shown in FIG. 5. In this embodiment, the transverse primary roof frame members are designated by reference numeral 112. Each of the transverse roof frame members 112 is supported at a medical location by a vertical supporting member 114 and, in the illustrated embodiment of the invention, one end of each transverse roof frame member is also supported by a second vertical supporting member 116. It will be noted that the arrangement of the vertical supporting members 116 is such that the opposite ends of adjacent pairs of transverse frame members 112 disposed at opposite sides of the hangar are supported by a vertical supporting member 116. The second end of each of the transverse frame members 112 is connected to a longitudinally extending primary roof frame member 118. Each of the transverse roof frame members 112 is thus not cantilevered, but is supported at one of its ends by connection to a longitudinally extending primary roof frame member 118, and at its other end by connection to one of the vertical supporting members 116.

Again, and as in the case of the previously described embodiments of the invention, a plurality of partition subassemblies are located within the hangar between the opposed parallel sides of the hangar, and each includes a plurality of vertical partition walls 100–108 which define at least two complementary T-shaped hangar compartments or spaces which open at opposite sides of the hangar. These partition walls have, in this instance, been denominated by the same reference numerals used in referring to those shown in FIG. 4. The longitudinally extending side walls 110 have also been identically numbered to those appearing in FIG. 4. Other identical reference numerals have been used for identifying identical structural components where they appear and are similarly used in the several embodiments of the invention which have been described.

In FIGS. 6 and 7 of the drawings, the eave construction which is preferably employed in the hangars of the present invention is illustrated. In the eave construction here utilized, the transverse primary frame members 112, as shown in FIG. 5, are secured at opposite ends to longitudinally extending roof frame members 118. Angle brackets 120 are employed to bolt the transverse frame members to the web of the longitudinal frame members as illustrated in FIGS. 6 and 7.

To the upper surface of the top flange **118*a* of the longitudinal roof frame member 118, one leg 121*a* of an angle clip 121 is bolted or otherwise suitably secured. The other leg 121*b* of the angle clip is secured to a central web portion 122*a* of an elongated angulated eave strut rail 122. A roof supporting web portion 122*b* is formed integrally with the central web portion 122*a*, and is connected to a downwardly extending guide flange 122*c* which extends normal to the roof supporting web portion. The roof supporting web portion 122*b* functions to support the roof panelling 24 adjacent the roof eaves. The central web portion 122*a* functions to support the upper edge portion of a vertical wall panel 110 which is secured to this section of the angulated rail by means of suitable bolts 128**.

The flange **122*c* functions as a guide for guiding the upper edge of a rolling hangar door subassembly, designated generally by reference numeral 130. The illustrated hangar door subassembly 130 is a hollow panel structure with a face plate 132 facing outwardly towards the outer side of the hangar, an inner plate or panel 134 and a top panel 136 which bridges across and covers the top of the hangar door subassembly. Welded, bolted or otherwise suitably secured to the top panel 136 is a tracking structure 138 which includes a pair of rollers 140 which guide upon and track the downwardly extending flange 122*c***.

An outwardly disposed finishing or eave trim rail 142 is secured to the angulated strut rail 122 and to the underside of the roof panel 124, and projects outwardly to a protective covering position over the upper edge of the face plate 132 of the door subassembly 130.

The described eave and door assembly of the present invention enables a single structural element to provide roof support at the eave location, guidance for the rolling door subassembly and support and structural securement for the vertical side wall panels employed on the hangar. In prior systems, a number of separate structural elements have been required to achieve these several functions.

From the foregoing description, it will be perceived that the present invention provides an improved T-hangar structure which has enhanced structural strength, is less costly to erect using conventional, readily available structural steel beams and which provides an improved roof eave and door structural combination. Although certain preferred embodiments of the invention have been herein described in order to illustrate the basic principles of the invention, it will be understood that various changes and modifications can be effected in the described structure without departure from such principles. Changes and modifications of this type are therefore deemed to be circumscribed by the present invention except as the same may be necessarily limited by the appended claims, or reasonable equivalents thereof.

What is claimed is:

1. An aircraft hangar comprising:

at least four substantially horizontal, transversely extending primary roof frame members;

substantially horizontal, longitudinally extending primary roof frame members located in horizontally spaced, substantially parallel relation and each connected to an end of at least two of said transversely extending primary roof frame members and providing the sole support of said transversely extending primary roof frame members at said ends;

a vertical supporting member supporting the central portion of each of said transversely extending primary roof frame members;

at least two additional vertical supporting members supporting each of said longitudinally extending primary roof frame members at locations spaced from opposite ends thereof and at locations spaced from said ends of said transversely extending primary roof frame members;

secondary roof frame members extending longitudinally of the hangar and supported upon said transversely extending primary roof frame members;

roof panelling means over and supported on said secondary roof frame members; and a partition assembly including a plurality of vertical partition walls defining at least two complementary, internesting T-shaped hangar spaces opening at opposite sides of the hangar.

2. An aircraft hangar as defined in claim 1 wherein said partition walls are supported by said vertical supporting members and include at least three walls supported by the vertical supporting members supporting said transversely extending primary roof frame members and extending substantially parallel to the opposite sides of the hangar.

3. An aircraft hangar as defined in claim 2 wherein the opening to each of said T-shaped hangar spaces is defined by two of said additional vertical supporting members and two of said vertical partition walls extending from said two additional vertical supporting members transversely into said aircraft hangar; and wherein said end of each of said transversely extending primary roof frame members is joined to an end of one of said longitudinally extending primary roof frame members at a location over each of said openings.

4. An aircraft hangar as defined in claim 2 and further characterized as including spaces between adjacent pairs of said additional vertical supporting members used in supporting two opposed, spaced and aligned ones of said longitudinally extending primary roof frame members, the dimensions of said spaces being wider than the wing span of an aircraft to be housed in said hangar, and each of said spaces extending under said ends of said transversely extending primary roof frame members.

5. An aircraft hangar as defined in claim 1 and further characterized as including spaces between adjacent pairs of said additional vertical supporting members used in supporting two opposed, spaced and aligned ones of said longitudinally extending primary roof frame members, the dimensions of said spaces being wider than the wing span of an aircraft to be housed in said hangar, and each of said spaces extending under said ends of said transversely extending primary roof framing members.

6. An aircraft hangar as defined in claim 1 wherein said hangar further includes an eave construction comprising:

an elongated, angulated eave strut rail connected to the upper side of longitudinally aligned ones of said longitudinally extending primary roof frame members at opposite sides of the hangar, said eave strut rails each including:

a vertically extending central web portion;

a roof-supporting web portion extending normal to said central web portion and supporting a portion of said roof panelling means near the outer edge portion thereof; and a downwardly extending guide flange connected to said roof-supporting web portion and projecting downwardly normal thereto; and a movable hangar door subassembly horizontally movable relative to said roof frame members and guidingly engaging said guide flange.

7. An aircraft hangar as defined in claim 6 wherein said partition walls are supported by said vertical supporting members and include at least three walls supported by the vertical supporting members supporting said transversely extending primary roof frame members and extending substantially parallel to the opposite sides of the hangar.

8. An aircraft hangar as defined in claim 7 wherein the opening to each of said T-shaped hangar spaces is defined by two of said additional vertical supporting members and two of said vertical partition walls extending from said two additional vertical supporting members transversely into said aircraft hangar; and wherein said end of each of said transversely extending primary roof frame members is joined to an end of one of said longitudinally extending primary roof frame members at a location over each of said openings.

9. An aircraft hangar as defined in claim 8 and further characterized as including spaces between adjacent pairs of said additional vertical supporting members used in supporting two opposed, spaced and aligned ones of said longitudinally extending primary roof frame members, the dimensions of said spaces being wider than the wing span of an aircraft to be housed in said hangar, and each of said spaces extending under said ends of said transversely extending primary roof framing members.

10. An aircraft hangar as defined in claim 9 and further characterized as including a plurality of horizontally spaced, vertical side wall panels secured at the upper ends thereof to said central web portion of said eave strut rail.

11. An aircraft hangar as defined in claim 1 wherein the opening to each of said T-shaped hangar spaces is defined by two of said additional vertical supporting members and two of said vertical partition walls extending from said two additional vertical supporting members transversely into said aircraft hangar; and wherein said end of each of said transversely extending primary roof frame members is joined to an end of one of said longitudinally extending primary roof frame members at a location over each of said openings.

12. A T-hangar for housing aircraft in staggered, oppositely facing directions comprising:

a pair of longitudinally extending, parallel, vertical side walls including a plurality of longitudinally spaced side wall panels having spacings therebetween for passing the wings of aircraft to be housed in the hangar, each side wall panel in one of said longitudinal side walls being directly opposite the space between side wall panels at the opposite longitudinal side of the hangar;

a longitudinally extending primary roof frame member extending along the upper side of each of said side wall panels with the opposite end portions of each of said longitudinally extending primary roof frame members projecting over a space between said side wall panels;

means securing each of said side wall panels to an adjacent longitudinally extending primary roof frame member;

a plurality of spaced, transversely extending roof frame members extending across the hangar between the side walls thereof and each having an end connected to one of the end portions of one of said longitudinally extending roof frame members which projects over said space;

roof means supported on said transversely extending primary roof frame members;

vertically extending partition walls between said hangar side walls and collectively defining a pair of contiguous internesting T-shaped aircraft hangar compartments having common partition walls therebetween and opening at said spaces on opposite sides of the hangar; and a vertical supporting member supporting the central portion of each of said transversely extending primary roof frame members at a location between the side walls of the hangar, and further supporting at least one of said vertically extending partition walls.

13. A T-hangar as defined in claim 12 wherein said means securing each side wall panel to an adjacent longitudinally extending primary roof frame member comprises an elongated angulated strut rail at opposite sides of the hangar and each having a central web portion connected to said longitudinally extending primary roof frame members located at one side of said hangar, and to said side wall panels at one side of said hangar, and extending across said spacings between said side wall panels;

a door-guiding flange; and a roof-supporting web portion extending between said central web portion and said door-guiding flange.

14. A T-hangar as defined in claim 13 and further characterized as including a pair of hangar door assemblies selectively closing each of said spacings and slidable apart from each other by horizontal movement, each of said hangar door assemblies including means guidingly engaging said door-guiding flange.

15. A T-hangar as defined in claim 12 and further characterized as including pairs of longitudinally spaced, vertically extending support members supporting each of said longitudinally extending primary roof frame members at locations spaced from the opposite ends thereof, and supporting one of said side wall panels.

16. A T-hangar as defined in claim 15 wherein two of said partition walls extend from each of said pairs of vertically extending support members inwardly into the hangar normal to said side walls and define portions of one of said T-shaped hangar compartments dimensioned to accommodate the tail section of an aircraft.

17. A T-hangar as defined in claim 16 wherein one of said partition walls is supported by each of said vertical supporting members and extends normal to one of said two partition walls which extends inwardly into the hangar.

18. A T-hangar as defined in claim 17 wherein said means securing each side wall panel to an adjacent longitudinally extending primary roof frame member comprises an elongated angulated strut rail at opposite sides of the hangar and each having a central web portion connected to said longitudinally extending primary roof frame members located at one side of said hangar, and to said side wall panels at one side of said hangar, and extending across said spacings between said side wall panels;

a door-guiding flange; and a roof-supporting web portion extending between said central web portion and said door-guiding flange.

19. A T-hangar as defined in claim 18 and further characterized as including a pair of hangar door assemblies selectively closing each of said spacings and slidable apart from each other by horizontal movement, each of said hangar door assemblies including means guidingly engaging said door-guiding flange.

20. A hangar for housing aircraft comprising:

a pair of opposed, longitudinally extending side walls including spaced side wall panels defining spaced openings to the interior of the hanger spaced along each of said side walls; and spaced longitudinally extending roof frame members at the upper sides of the side wall panels;

spaced transversely extending transverse roof frame members extending between and connected to said longitudinally extending roof frame members;

vertically extending supporting members supporting said transversely extending roof frame members and said longitudinally extending roof frame members; and at least one elongated, longitudinally extending, angulated eave strut rail extending along each of the longitudinal sides of said hangar over said side wall panels and the spaced openings to the interior of the hangar, said eave strut rails each including:

a central web portion projecting in a vertical plane and having said side wall panels secured thereto;

a roof support web portion projecting horizontally from an upper edge of said central web portion and away from the interior of the hangar; and a guide flange projecting vertically downwardly from an outer edge of said roof support web portion and spaced from said central web portion and said side wall panels and extending substantially parallel thereto;

means connecting said central web portion to said longitudinally extending roof frame members;

panels supported on said roof support web portions; and hangar door means rollably and guidingly engaging said guide flange for opening and closing movement in a plane substantially parallel to said side wall panels connected to said central web portion.

* * * * *